US007765752B2

(12) United States Patent
Hayes et al.

(10) Patent No.: US 7,765,752 B2
(45) Date of Patent: Aug. 3, 2010

(54) ANCHOR SYSTEM WITH SUBSTANTIALLY LONGITUDINALLY EQUAL WEDGE COMPRESSION

(75) Inventors: Norris O. Hayes, Stafford, TX (US); Randy Draginis, Terrell, TX (US)

(73) Assignee: Hayes Specialty Machining, Ltd., Sugar Land, TX (US)

( * ) Notice: Subject to any disclaimer, the term of this patent is extended or adjusted under 35 U.S.C. 154(b) by 0 days.

(21) Appl. No.: 12/033,939

(22) Filed: Feb. 20, 2008

(65) Prior Publication Data

US 2009/0205273 A1 Aug. 20, 2009

(51) Int. Cl.
*E04C 5/08* (2006.01)

(52) U.S. Cl. ..... 52/223.13; 52/223.14; 52/223.6; 52/231; 405/259.1; 403/374.1

(58) Field of Classification Search ..... 52/223.13, 52/223.14, 223.1, 223.4, 223.7, 223.8, 231; 24/122.6; 403/2, 27, 314, 300, 374.1, 371; 405/302.2, 259.1, 259.4
See application file for complete search history.

(56) References Cited

U.S. PATENT DOCUMENTS 3,399,434 A * 9/1968 Kelly ..... 403/194
3,524,228 A * 8/1970 Kelly ..... 403/369
3,588,045 A * 6/1971 Stubbs ..... 254/29 A
3,605,361 A * 9/1971 Howlett et al. ..... 52/223.13
3,703,748 A * 11/1972 Kelly ..... 403/368
3,757,390 A * 9/1973 Edwards ..... 24/115 R
3,820,832 A * 6/1974 Brandestini et al. ..... 24/115 A
3,895,879 A * 7/1975 Burtelson ..... 403/369
3,912,406 A * 10/1975 McGrath ..... 403/19
3,937,607 A * 2/1976 Rodormer ..... 425/111
4,343,122 A * 8/1982 Wlodkowski et al. .... 52/223.13
4,586,303 A * 5/1986 Jartoux et al. ..... 52/309.16
4,604,003 A * 8/1986 Francoeur et al. ..... 405/256
4,648,147 A * 3/1987 Zimmermann et al. ..... 14/21
4,662,134 A * 5/1987 Illgner ..... 52/223.13
4,718,209 A * 1/1988 Hansen et al. ..... 52/223.13
4,799,307 A * 1/1989 Reigstad et al. ..... 29/452
4,941,303 A * 7/1990 Jartoux ..... 52/223.13
5,082,031 A * 1/1992 Suhr ..... 139/91

(Continued)

FOREIGN PATENT DOCUMENTS

DE 102004033015 A1 3/2005

OTHER PUBLICATIONS

International Search Report; International Application No. PCT/US2009/043367; mailed on Jul. 6, 2009.

*Primary Examiner*—Richard E Chilcot, Jr.
*Assistant Examiner*—James Ference
(74) *Attorney, Agent, or Firm*—Richard A. Fagin

(57) ABSTRACT

An anchor system for a tendon includes a load transfer device having at least one wedge receiving bore therein. The wedge receiving bore has a tapered interior surface. The anchor system also includes a wedge configured to be affixed to an exterior surface of a tendon. The wedge has a tapered exterior surface configured to cooperate with the tapered interior surface of the wedge receiving bore to laterally compress the wedge against a tendon when the wedge is moved longitudinally into the bore. Taper angle of the wedge and a taper angle of the wedge receiving bore are selected such that longitudinal compressive force exerted by the wedge is substantially evenly longitudinally distributed.

7 Claims, 3 Drawing Sheets

U.S. PATENT DOCUMENTS 5,086,811 A * 2/1992 Suhr ..... 139/91
5,259,703 A * 11/1993 Gillespie ..... 405/259.6
5,278,353 A * 1/1994 Buchholz et al. ..... 174/84 R
5,493,828 A * 2/1996 Rogowsky et al. ..... 52/223.13
5,535,561 A * 7/1996 Schuyler ..... 52/223.13
5,630,301 A * 5/1997 Sieg ..... 52/223.13
5,669,189 A * 9/1997 Logiadis et al. ..... 52/167.4
5,755,065 A * 5/1998 Sorkin ..... 52/223.13
5,939,003 A * 8/1999 Crigler et al. ..... 264/228
6,017,165 A * 1/2000 Sorkin ..... 403/374.1
6,195,949 B1 * 3/2001 Schuyler ..... 52/223.13
6,234,709 B1 * 5/2001 Sorkin ..... 403/374.1
6,322,091 B1 * 11/2001 Lindley ..... 280/149.2
6,322,281 B1 * 11/2001 Jungwirth et al. ..... 403/278
6,381,912 B1 * 5/2002 Sorkin ..... 52/223.13
6,513,287 B1 * 2/2003 Sorkin ..... 52/223.13
6,684,585 B2 * 2/2004 Campbell ..... 52/223.13
6,718,707 B2 * 4/2004 Marshall ..... 52/223.13
6,761,002 B1 * 7/2004 Sorkin ..... 52/223.13
6,817,148 B1 * 11/2004 Sorkin ..... 52/223.13
6,883,280 B2 * 4/2005 Hayes ..... 52/223.13
7,147,404 B2 * 12/2006 Spearing et al. ..... 405/259.5
7,174,685 B2 * 2/2007 Hayes ..... 52/223.6
7,275,347 B2 * 10/2007 Hayes ..... 52/223.13
7,360,342 B2 * 4/2008 Hayes et al. ..... 52/223.14
2002/0076274 A1 6/2002 Carlsen et al.
2006/0096196 A1 * 5/2006 Hayes et al. ..... 52/223.13
2006/0117683 A1 * 6/2006 Hayes et al. ..... 52/223.13
2006/0179742 A1 8/2006 Mathews et al.
2006/0201083 A1 * 9/2006 Hayes et al. ..... 52/223.13

* cited by examiner

ANCHOR SYSTEM WITH SUBSTANTIALLY LONGITUDINALLY EQUAL WEDGE COMPRESSION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of tendon anchoring devices for post-tension concrete reinforcing systems. More particularly, the invention relates to taper angles for wedges and anchor bases used in such devices and arrangement of the initial gap position of the segments of a retaining wedge to improve tensile strength of tendon anchoring systems.

2. Background Art

The present invention is described herein primarily with reference to post-tension anchoring devices and systems. However, the invention can be used in any application requiring retention of a tendon within an anchorage or other device that transfers tension from the tendon to another structure. Such applications include, without limitation, prestress chucks and couplers, post tensioning applications for bridges, post tension jacks, cable stay wedges, post tensioning applications for roads, bridge tie-backs, mine shaft wall and roof retainers, wall retainers and wall forming systems, multi head stressing jacks, heavy cable lifting systems, post tensioning slabs, barrier cable systems and single post tensioning rams.

As is relates to post-tension anchoring systems, the background of the invention can be described as follows. For quite some time, the design of concrete structures imitated typical steel structure designs of columns, girders and beams. With technological advances in structural concrete, however, designs specific to concrete structures began to evolve. Concrete has several advantages with respect to steel, including lower cost, not requiring fireproofing, and having plasticity, a quality that lends itself to free flowing or boldly massive architectural concepts. On the other hand, structural concrete, though quite capable of carrying almost any compressive (vertical) load, is essentially unable to carry significant tensile loads. In order to enable concrete structures to carry tensile loads, it is necessary, therefore, to add steel bars, called reinforcements, to the concrete. The reinforcements enable the concrete to carry the compressive loads and the steel to carry the tensile (horizontal) loads.

Structures made from reinforced concrete may be built with load-bearing walls, but this configuration does not use the full potential of the concrete. The skeleton frame, in which the floors and roofs rest directly on exterior and interior reinforced-concrete columns, has proven to be most economical and popular method of building concrete structures. Reinforced-concrete framing appears to be a quite simple form of construction. First, wood or steel forms are constructed in the sizes, positions, and shapes called for by engineering and design requirements. Steel reinforcing is then placed and held in position by wires at its intersections. Devices known as chairs and spacers are used to keep the reinforcing bars apart and raised off the formwork. The size and number of the steel bars depends upon the imposed loads and the need to transfer these loads evenly throughout the building and down to the foundation. After the reinforcing is set in place, the concrete, a mixture of water, cement, sand, and stone or aggregate, of proportions calculated to produce the required compressive strength, is placed, care being taken to prevent voids or honeycombs.

One of the simplest designs for concrete frames is the beam-and-slab. The beam and slab system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be used over and over for the same shape. The beam and slab system, therefore, produces an economically advantageous structure.

With the development of flat-slab construction, exposed beams can be eliminated. In the flat slab system, reinforcing bars are projected at right angles and in two directions from every column supporting flat slabs spanning twelve or fifteen feet in both directions. Reinforced concrete reaches its highest potentialities when it is used in pre-stressed or post-tensioned members. Spans as great as 100 feet can be attained in members as deep as three feet for roof loads. The basic principle is simple. In pre-stressing, reinforcing rods of high tensile strength steel are stretched to a certain determined limit and then high-strength concrete is placed around them. When the concrete has set, it holds the steel in a tight grip, preventing slippage or sagging. Post-tensioning follows the same principle, but the reinforcing is held loosely in place while the concrete is placed around it. The reinforcing is then stretched by hydraulic jacks and securely anchored into place. Prestressing is performed with individual members in the shop and post-tensioning is performed as part of the structure on the construction site. In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

One such post tensioning system is described in U.S. Pat. No. 3,937,607 issued to Rodormer. The general principle is explained with respect to FIG. 3 in the '607 patent and states, in relevant part, "[i]n accordance with conventional techniques, a center hole electro-hydraulic jack is placed on each tendon to tension the tendon. When the jack is released the live end anchor chuck 40 will set and grip the tendon holding the latter at the desired tension." The retaining wedge known in the art is typically a conical-exterior shaped insert that fits in a mating, tapered opening in an anchor plate. The mated, tapered opening in the anchor plate is typically referred to as a bore. The wedge may be divided into two or more circumferential segments to enable application to the exterior of the tendon or cable prior to insertion into the opening in the anchor plate. The interior opening of the wedge typically includes conventional buttress threads in order to deform and thus grip the exterior surface of the tendon or cable, such that when the jack or tensioning device is released, the tension in the tendon will be transferred to the wedge, and thus to the anchor plate (or other load transfer device).

The wedge and the wedge receiving bore of all anchor systems known in the art have a taper angle of about seven degrees from the longitudinal axis of the wedge and the wedge receiving bore. Within variations of design for anchor systems known in the art, the mean taper angle of the wedge receiving bore is typically within twenty minutes of arc (⅓ degree) of the mean taper angle of the wedge used with the particular anchor base.

SUMMARY OF THE INVENTION

One aspect of the invention is an anchor system for a tendon. Such an anchor system includes a load transfer device having at least one wedge receiving bore therein. The wedge receiving bore has a tapered interior surface. The anchor system also includes a wedge configured to be affixed to an exterior surface of a tendon. The wedge has a tapered exterior surface configured to cooperate with the tapered interior surface of the wedge receiving bore to laterally compress the wedge against the tendon when the wedge is moved longitudinally into the bore. Taper angle of the wedge and a taper angle of the wedge receiving bore are selected such that longitudinal compressive force exerted by the wedge is substantially evenly longitudinally distributed.

Other aspects and advantages of the invention will be apparent from the following description and the appended claims.

DETAILED DESCRIPTION

Generally, the invention includes tendon retaining wedges and/or load transfer devices (such as post tension anchor plates) formed to have particular features as will be explained below in more detail. Some embodiments of wedge segments and/or load transfer devices according to the invention are intended to be used with post-tension anchor systems, and for purposes of illustrating the invention, a post tension anchor base and wedge system will be explained. However, wedges and/or anchor plates according to various aspects of the invention may be used with any other application for a tendon-type load transfer system, including, without limitation, the various applications described in the Background section herein.

Figure 1:
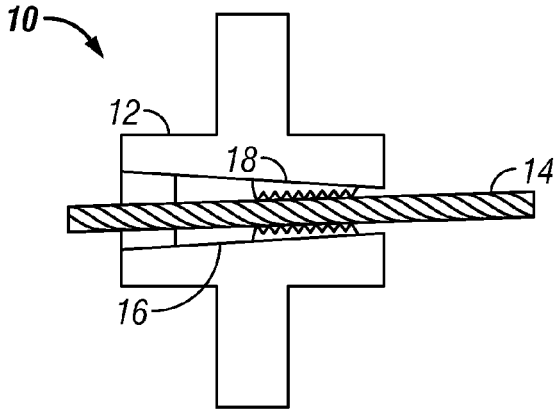
FIG. 1 (Prior Art)
FIG. 1 shows a typical post tension anchor system.

An assembled post-tension anchor system and post-tension tendon known in the art prior to the present invention are shown generally in cross section in FIG. 1. The anchor system 10 includes load transfer device, which in the present example can be a post tension reinforcing an anchor plate or anchor base 12, usually cast or forged from a ductile metal. The anchor base 12 is configured to be cast into or otherwise affixed to a concrete member (not shown in FIG. 1) that is to be reinforced using the tendon and anchor system. The anchor base 12 includes a generally tapered wedge receiving bore 16 for receiving and holding an anchor wedge 18. The anchor wedge 18 is preferably formed from two or more circumferential wedge segments, as will be explained below with reference to FIG. 3, and includes on its inner surface a plurality of inwardly projecting gripping elements to penetrate and grip the outer surface of a reinforcing tendon 14. The wedge segments have a generally tapered exterior surface arranged to cooperate with internally tapered surface of the wedge receiving bore 16 so as to laterally compress the wedge 18 against the tendon 14 as axial tension (tension along the longitudinal axis of the tendon 14) is applied to the tendon 14. The exterior surface of the wedge 18 and the correspondingly tapered inner surface of the receiving bore 16 cooperate to laterally squeeze the circumferential segments of the wedge 18 together such that the wedge grips the tendon 14 tightly, thus restraining the tendon 14 from axial movement when the wedge 18 is fully engaged in the receiving bore 16. During assembly of the anchor system 10, the tendon 14 is placed in tension, and the wedge segments are applied to the exterior of the tendon 14. When the tension is released from the tendon 14, the wedge 18 is pulled into the receiving bore 16 in the anchor base 12. The anchor base 12 thus serves the purpose of transferring tension from the tendon 14 to the structure (not shown) of which the anchor base is affixed, so as to apply a compressive force to the structure (not shown). In embodiments used in applications other than post-tension reinforcement, any other known type of load transfer device can perform the load transferring function of the anchor base 12. Such devices may include, without limitation, cylindrically shaped panel retainers such as mine roof retainers.

The anchor base 12 shown in FIG. 1 includes only one receiving bore 16. However, other embodiments of an anchor base or load transfer device may include any number of such receiving bores. The receiving bore configuration of the anchor base 12 shown in FIG. 1 is therefore not intended to limit the scope of the invention.

Figure 2:
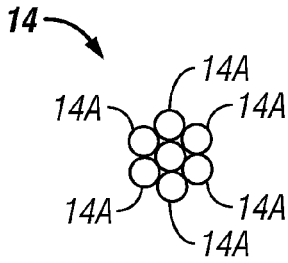
FIG. 2 (Prior Art)
FIG. 2 shows a section of a typical tendon.

FIG. 2 shows an end view of a typical tendon 14. The tendon in this example is made from six, high tensile strength steel wires 14A, generally wound in a helical pattern around a centrally positioned, seventh wire 14A. In one embodiment, the wires 14A are made from steel having a tensile strength of 270,000 pounds per square inch (psi). Typically, the steel from which the wires 14A are made has a surface hardness in a range of about 40-54 Rockwell "C." The foregoing specifications for the wires 14A are only meant to serve as examples of wires that are used in post tension reinforcement systems, and are not intended to limit the scope of the invention. The foregoing description of the tendon 14 is meant to serve only to explain the principle by which the invention works. Accordingly, as used in this description, the term "tendon" is intended to include any element that is placed under tensile stress under ordinary operation. The tensile stress is communicated, through the wedges, to a load transfer device, which in the present embodiment includes the anchor base 12. The purpose of the load transfer device, as explained above, is to transfer the tensile stress in the tendon to a structure that is in contact with the load transfer device. Any tendon structure and/or material known in the art for use in such reinforcing systems may also be used in different embodiments, including, without limitation, single-strand tendons, steel bars, wire rope, composite (e.g. fiber reinforced plastic) tendons, guide wire and the like.

Figure 3:
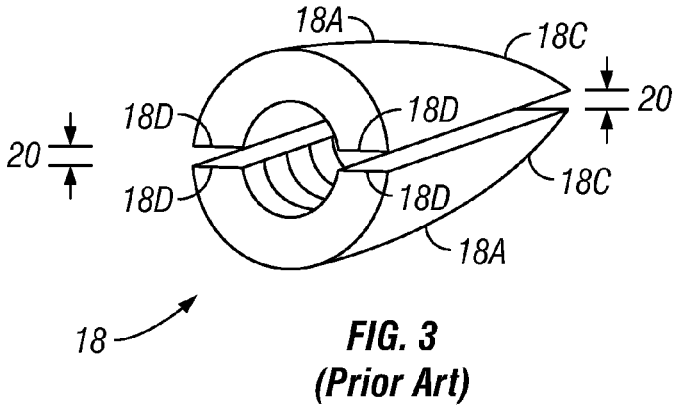
FIG. 3 (Prior Art)
FIG. 3 shows a prior art retaining wedge.

FIG. 3 shows an example of a prior art wedge 18 made from two circumferential wedge segments 18A, in order to more clearly delineate the novel features of a wedge made according to the present invention. The prior art wedge 18 is typically formed by machining, or forging, a single, truncated cone-shaped metal body (not shown separately in the Figures)

from a soft steel alloy, although the process for forming the wedge body is not a limitation on the scope of the invention. A hole is typically drilled in the single, cone-shaped metal body (not shown), and then the gripping elements can be formed inside the hole. The gripping elements are typically formed by threading, however other structures and method for forming the gripping elements are known in the art. Typical threads known in the art for use on anchor wedges include so-called "buttress" threads, or may be other industry standard thread types known by designations "UNC" (unified coarse thread) or "UNF" (unified fine thread, also known as Society of Automotive Engineers—SAE thread). The exterior surface of each wedge segment 18A is tapered such that a small diameter 18C exists on one end. Typically, the wedge segments 18A are formed such that when applied to the exterior of the tendon (14 in FIG. 1), there is a gap 20 between the circumferential ends 18D of each wedge segment 18A to enable lateral compression against the tendon as the wedge 18 is moved into the receiving bore (16 in FIG. 1).

As explained above, when using wedges known in the art prior to the present invention, it is believed that one source of the failure of the tendon during axial stress testing is a reduction of the effective external diameter of the tendon and the formation of stress risers resulting from relatively deep penetration of the surface of the tendon (14 in FIG. 1) by the gripping elements (threads) on the interior surface of the wedge segments 18A, and corresponding extrusion of the tendon material. In typical prior art anchor systems, it has been determined through testing to tendon failure that the point of failure of the tendon (14 in FIG. 1) is frequently at an axial position near the first thread (gripping element) on the wedge 18. Testing to failure also has demonstrated that the typical mode of failure is for only one of the wires (14A in FIG. 2) in a 7 wire PC strand tendon (such as shown in FIG. 2) to fail prior to the other wires.

Figure 4:
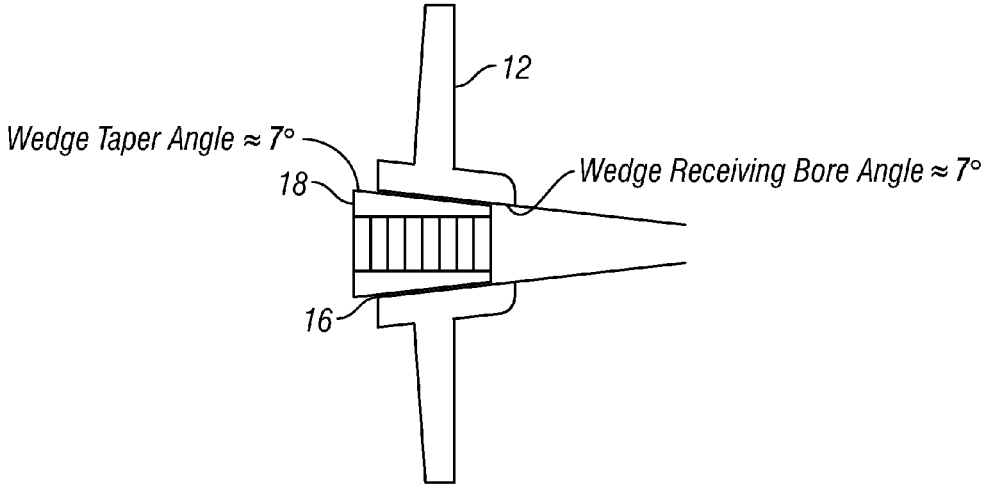
FIG. 4 (Prior Art)
FIG. 4 shows a prior art retaining wedge with a conventional wedge and bore taper angle.

As explained above, it is currently known to those of ordinary skill in the art that both the exterior surface of the wedge and the interior surface of the wedge receiving bore typically have a taper angle of about seven degrees. The taper angles in various prior art implementations may be as much as ½ degree more or less than the nominal seven degrees. Therefore, it is known in the art that in many cases the taper angles for the wedge and for the wedge receiving bore are between 6½ and 7½ degrees. However, for all wedges and wedge receiving bores known in the art prior to the present invention, the taper angle of the wedge and the wedge receiving bore do not differ from each other by more than about 20 minutes (⅓ degree). An example of the wedge and receiving bore taper angle known in the art prior to the invention of about 7 degrees is shown in FIG. 4.

In examples of a wedge and a wedge receiving bore according to one aspect of the invention, the taper angle of the exterior surface of the wedge and the corresponding taper angle of the wedge receiving bore in the anchor base are particularly selected so that lateral compressive force exerted by the wedge against the tendon is substantially evenly longitudinally distributed along the wedge when the wedge is fully engaged with the wedge receiving bore.

In some examples, the taper angle of the exterior surface of the wedge may be between seven and eight degrees, and more preferably about 7½ degrees. The corresponding taper angle of the wedge receiving bore may be about 6 degrees.

Figure 5:
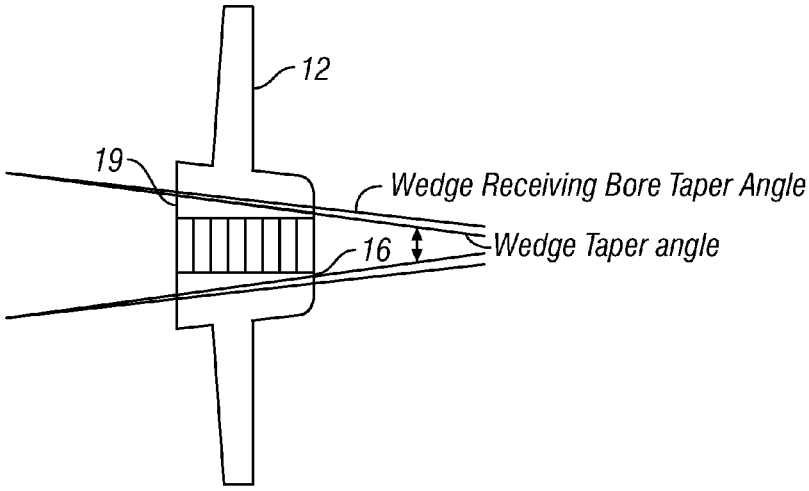
FIG. 5 shows another embodiment of a wedge and anchor according to the invention.

In other examples, the taper angle of the exterior surface of the wedge may be eight degrees or more when used with a seven degree tapered wedge receiving bore. It has been determined through testing that good tensile strength test results are obtained when the taper angle of the exterior surface of the wedge exceeds the taper angle of the wedge receiving bore by a minimum of about 1° and by about a maximum of 2°. In the first example, a difference between the wedge receiving bore taper angle and the wedge taper angle is about 1½ degrees. Selecting such a taper angle difference in such range has been found to produce lateral compressive forces that are substantially evenly longitudinally distributed along the length of the anchor wedge 19, as shown in FIG. 5. The taper angle difference range of about 1° to 2° is not intended as limiting and other taper angle differences between the anchor wedge 19 and the wedge receiving bore 16 of the anchor base are within the scope of the present invention.

Figure 5A:
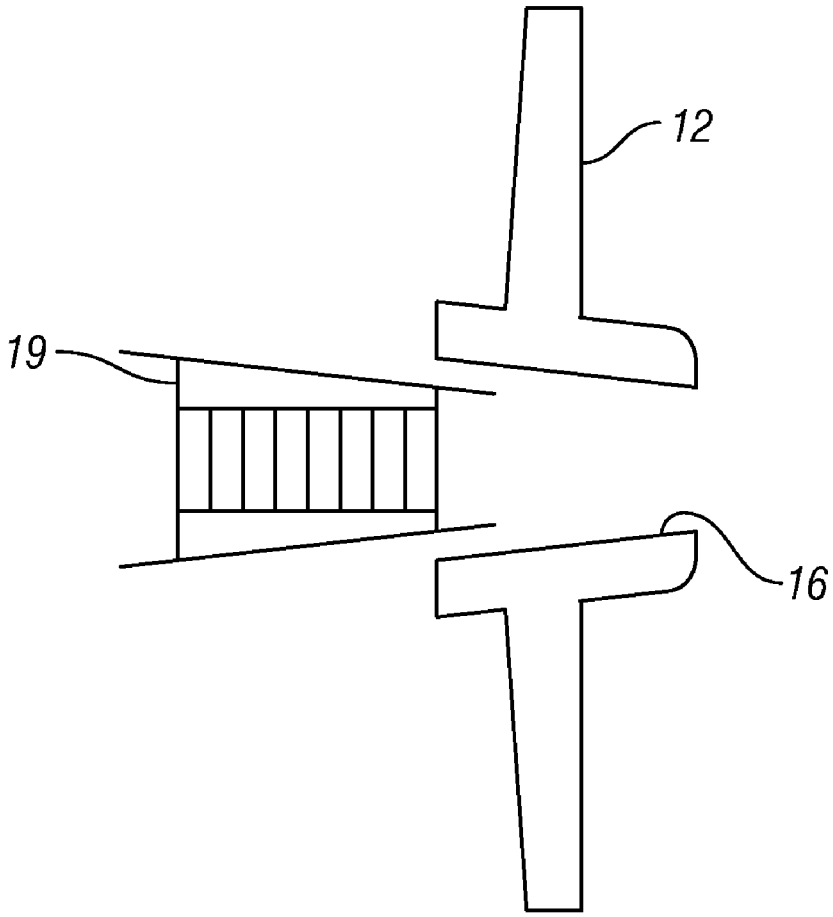
FIG. 5A shows the embodiment of FIG. 5 before the anchor wedge is moved into the wedge receiving bore of the anchor base.

FIG. 5A shows the embodiment of FIG. 5 before the anchor wedge is moved into the wedge receiving bore of the anchor base.

The foregoing embodiments, as previously explained, are described with respect to post-tension concrete reinforcing systems. It should be understood that other applications for tendon anchoring, such as mine wall and/or roof retention, bridge supports, wall supports, and other tendon retaining systems such as described in the Background section herein may have application for a tendon retaining system according to the invention to improve the tensile strength thereof.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A concrete anchor system for a tendon, comprising:

a load transfer device having at least one wedge receiving bore therein, the receiving bore having a tapered interior surface, the taper having a first angle in a portion thereof that directly contacts an exterior surface of a wedge when the system is assembled; and a wedge configured to be affixed to an exterior surface of a tendon, the wedge having a tapered exterior surface configured to cooperate with the tapered interior surface of the wedge receiving bore to laterally compress the wedge against the tendon when the wedge is moved longitudinally into the bore, the wedge having a second taper angle larger than the first taper angle, the first and second taper angles selected such that compressive force exerted by the wedge against the tendon is substantially evenly longitudinally distributed when the wedge is fully engaged in the receiving bore with the tendon under tension, wherein a difference between the first angle and the second angle is in a range of one to two degrees.

2. The system of claim 1 wherein the taper angle of the wedge is between eight and nine degrees.

3. The system of claim 1 wherein the taper angle of the wedge receiving bore is seven degrees.

4. The system of claim 1 wherein a difference between the taper angle of the wedge and the taper angle of the wedge receiving bore is at least 1½ degrees.

5. The anchor system of claim 1 wherein the load transfer device comprises an anchor base.

6. The system of claim 1 wherein the taper angle of the wedge is between seven and eight degrees.

7. The system of claim 1 wherein the taper angle of the wedge receiving bore is six degrees.

* * * * *